United States Patent [19]

Sartor et al.

[11] Patent Number: 4,619,057

[45] Date of Patent: Oct. 28, 1986

[54] TIGHTENING AND ADJUSTING DEVICE PARTICULARLY FOR SKI BOOTS

[75] Inventors: Leo Sartor, Caerano; Franco Gobbo, Falzé Di Trevignano, both of Italy

[73] Assignee: Caber Italia S.p.A., Montebelluna, Italy

[21] Appl. No.: 738,338

[22] Filed: May 28, 1985

[30] Foreign Application Priority Data

Jun. 1, 1984 [IT] Italy ..... 41587 A/84

[51] Int. Cl.[4] ..... A43B 11/00; A43B 5/04

[52] U.S. Cl. ..... 36/50; 36/117; 36/120; 24/68 R; 24/68 SK

[58] Field of Search ..... 36/117–121, 36/50; 24/68 R, 68 SK, 69 SK, 70 SK, 71 SK, 68 BT, 68 D

[56] References Cited

U.S. PATENT DOCUMENTS

| | | | |
|---|---|---|---|
| 589,877 | 9/1897 | Vedder | 24/68 R |
| 2,670,924 | 3/1954 | Baty | 24/68 R |
| 4,160,332 | 7/1979 | Salomon | 36/119 |
| 4,428,099 | 1/1984 | Richmond | 24/68 R |

FOREIGN PATENT DOCUMENTS

| | | | |
|---|---|---|---|
| 0053340 | 6/1982 | European Pat. Off. | 36/120 |
| 3342331 | 5/1984 | Fed. Rep. of Germany | 36/50 |
| 3342121 | 6/1984 | Fed. Rep. of Germany | 36/117 |
| 2399811 | 3/1979 | France | 36/119 |
| 2448872 | 9/1980 | France | 36/117 |

*Primary Examiner*—James Kee Chi

[57] ABSTRACT

The device is composed of a vertical axle positioned in a case made rigid with the rear half-shell of the quarter of ski footwear. The axle having at a middle region thereof, an inclined tooth gear which is actuated by a ratchet lever to cause its co-directional rotation with winding of stays having second ends associated with the front portion of the quarter thus effecting the closure of the boot. The lower end of said axle includes a thread portion adapted to cause upward movement of a block which in turn causes tensioning of cables associated with an element positioned on the foot instep, thereby causing tightening of the same. Also provided are a means of releasing the inclined tooth gear with consequent opening of the boot quarter, and a means of adjusting the tension exerted by the upward movement of the block on the cables.

4 Claims, 5 Drawing Figures

TIGHTENING AND ADJUSTING DEVICE PARTICULARLY FOR SKI BOOTS

BACKGROUND OF THE INVENTION

This invention relates to a tightening and adjusting device, particularly for ski boots.

More specifically, the invention is directed to a device which is conveniently applied to ski boots wherein the quarter consists of two parts, substantially separated by a vertical centerplane and hinged to each other at the bottom portion.

These are so-called rear-opening boots wherein the foot introduction occurs solely by opening the quarter.

The technical problems encountered with such boot types and associated with their closure devices result from the fact that devices must be provided which permit the quarter to be closed and also permit the foot toe portion to be secured within the shell.

Known are devices which perform such dual functions in an independent fashion as well as devices which effect a clamping action on the foot instep as the two parts which make up the quarter are brought together.

However, such devices are either composed of several independent parts, or are difficult to adjust.

SUMMARY OF THE INVENTION

It is an object of this invention to provide a simple device which is capable of closing the quarter of a ski boot, or other footwear with a split leg portion.

Another object is to provide a device which allows the foot to be secured within the footwear shell.

A further object is to provide a single device for simultaneously effecting closure of the quarter and tightening of the foot.

Still another object is to provide a device whereby the quarter and foot tightening forces can be adjusted independently.

A further object is to provide a device which is readily releasable, compact, and of low cost.

These and other objects such as will be apparent hereinafter, are achieved by a tightening and adjusting device particularly for ski boots including a shell having an instep portion, and a leg portion defining a quarter including two sections articulated to each other, characterized in that it comprises actuating means, entrainment means, housing means and at least one stay member, said stay member defining a working length and having at least one end thereof attached to one of said two sections and an entrainable portion adapted to be entrained by said entrainment means, said actuating means and said entrainment means being located on one of said two sections, other than said at least one of said two sections articulated to each other whereto said end of said stay is attached and being at least partially contained in said housing means, said entrainment means being adapted for co-operation with said actuating means for adjusting the working length of said stay member.

According to another aspect of the present invention, the cited objects are achieved by a tightening and adjusting device, characterized in that it comprises a presser element adapted for exerting pressure at said instep portion, at least one link element including a tractable portion and defining a working length dimension and having at least one end thereof attached to said presser element, traction means, and adjustment means, said traction means being adapted for co-operation with said actuating means for varying said working length dimension defined by said at least one link element, said adjustment means being adapted for varying said working length dimension defined by said at least one link element independently of said actuating means.

BRIEF DESCRIPTION OF THE DRAWINGS

Further features and advantages of the invention will be more clearly apparent from the following detailed description of a preferred embodiment given herein by way of illustration and not of limitation with reference to the accompanying drawings, where.

DESCRIPTION OF THE PREFERRED EMBODIMENTS

Figure 1:
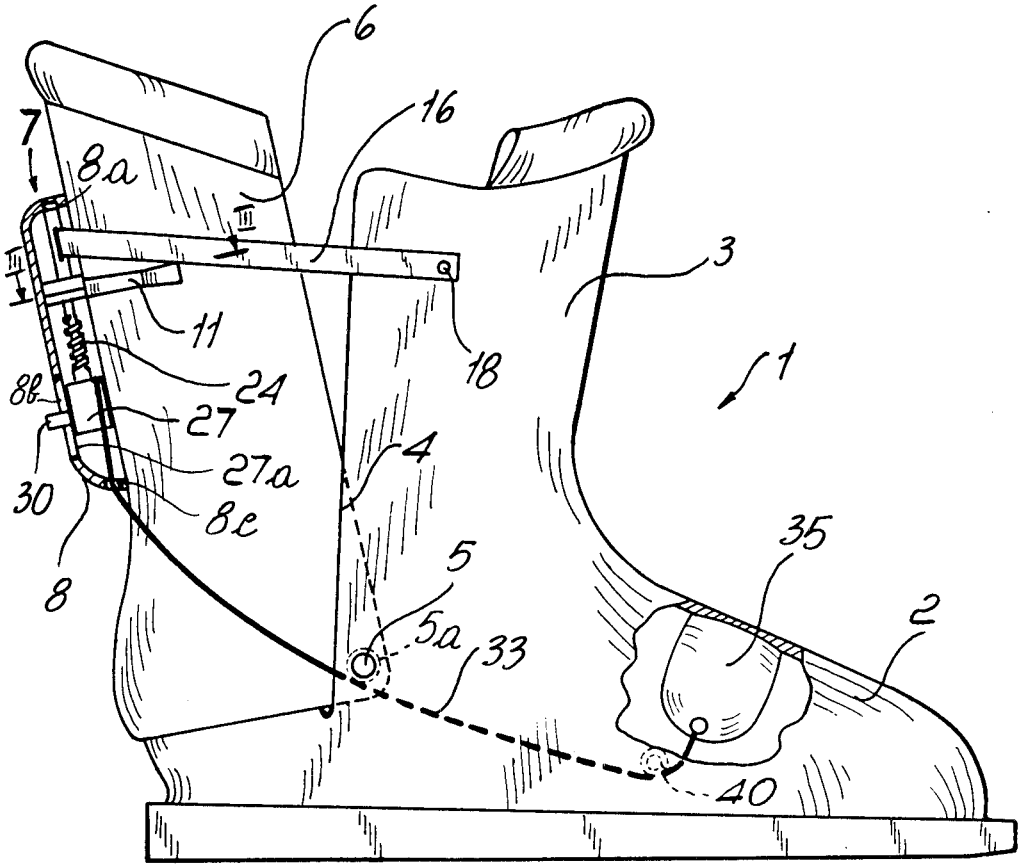
FIG. 1 is a partially sectional general schematic view of a ski boot employing the device of this invention.

With reference to the cited drawing figures, a ski boot generally indicated at 1 consists of a shell 2 and a leg portion comprising a front half-quarter 3 to which there is connected, substantially at the lower portion of an openable flap 4, by means of an articulation 5, a complementary rear half-quarter 6 the opening whereof determines the possibility of an easy introduction of the foot into the footwear.

Attached to said leg portion, advantageously at a rear middle region of said half-quarter 6 is the tightening device 7 contained on the interior of housing means comprising a case 8, which is expediently made rigid with the leg portion by connection means such as rivets, not shown because known per se, or alternatively formed integrally therewith.

Figure 2:
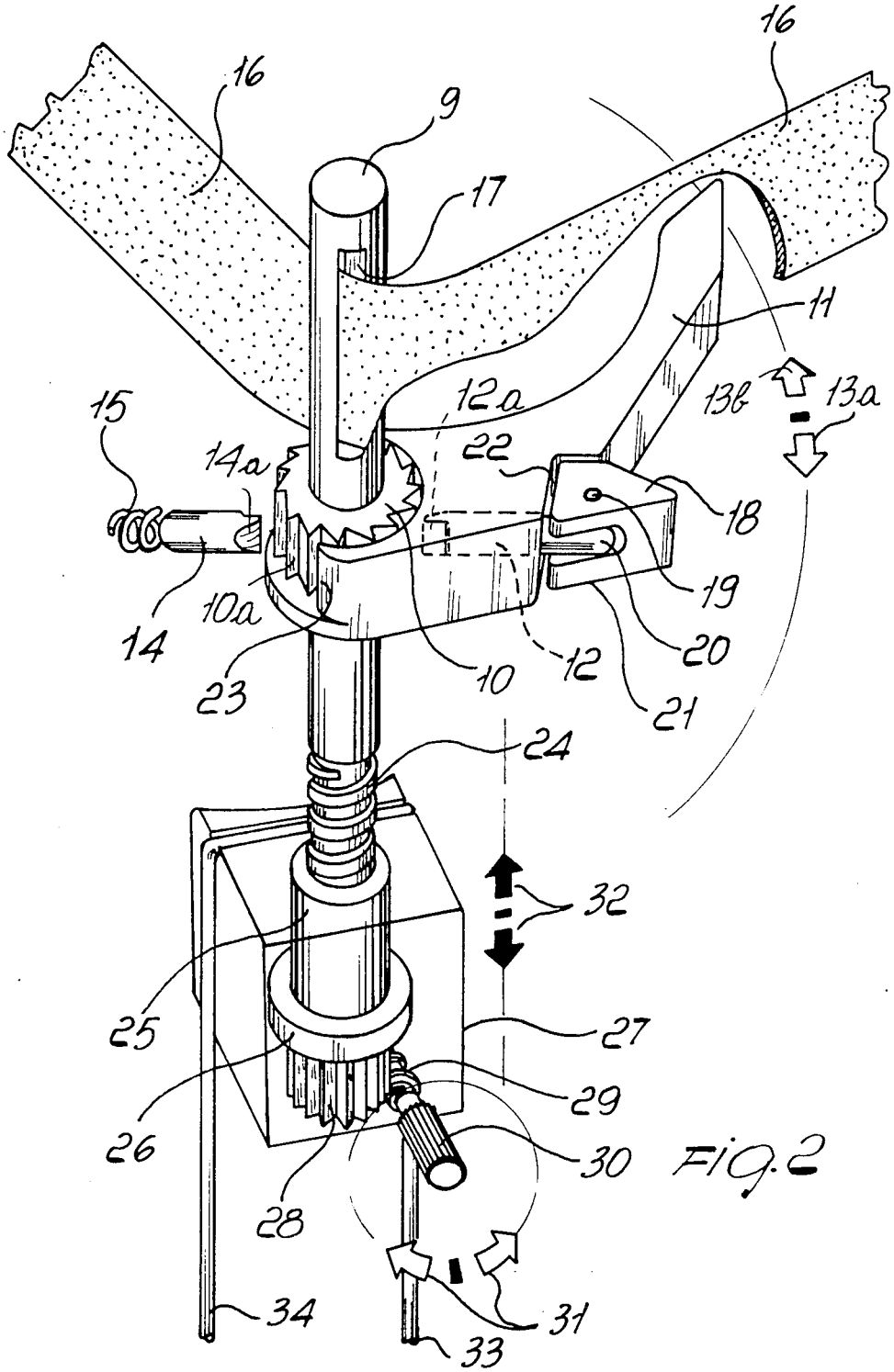
FIG. 2 is a schematic perspective view of the constituent parts of the device of this invention.

The tightening device more clearly shown in FIG. 2 is composed of a vertical axle 9, the top end of which is rotatably supported in a seat **8*a* formed in the inner portion of the case 8** which permits its rotation.

Said vertical axle 9 has, rigidly associated therewith, at a substantially middle region thereof, a gear wheel 10 having inclined teeth **10*a* formed thereon and on which acts a ratchet lever 11, provided with a first ratchet mechanism or pawl 12, adapted to move together with the lever 11, said pawl 12 being partially contained in a housing 11*a* formed in said lever 11 and elastically biased by a spring 12*b* towards the gear wheel 10. The pawl 12 includes a tip 12*a*, correspondingly shaped to fit in between the teeth 10*a* of the gear 10** and being adapted to engage therewith when oscillated in a clockwise direction and to disengage therefrom when oscillated in an anti-clockwise direction.

By oscillating the lever 11 in the direction indicated by the arrow **13*a* (FIG. 3) there occurs in a clockwise direction with respect to the figure, the entrainment of the gear 10 and consequently of the axle 9 by virtue of the fact that the tip 12*a* of the pawl 12 is caused to engage with the teeth 10*a* of the gear 10**.

Figure 3:
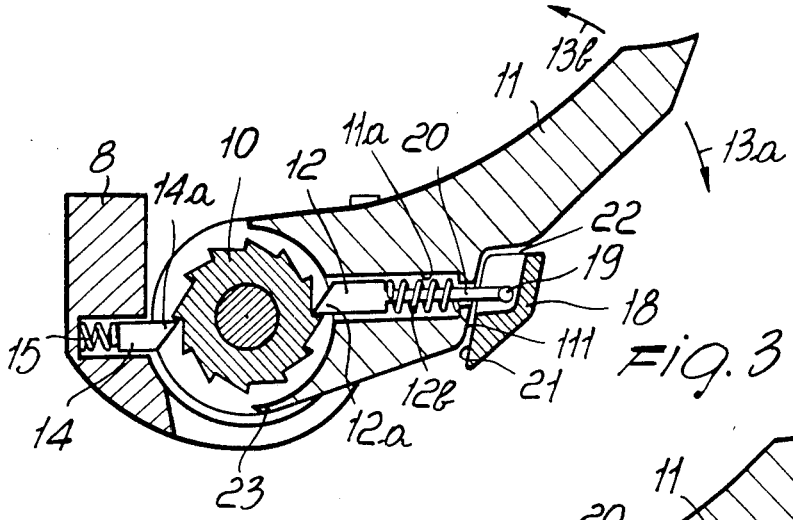
FIG. 3 is a sectional plan view of a ratchet level mechanism of the device according to the invention, in an engaged condition thereof, taken on the line III—III of FIG. 1.

Conversely, when the lever 11 is oscillated in an anti-clockwise direction, as indicated by the arrow 13*b*, there occurs the recovery of the ratchet lever 11 with elastic disengagement of the first ratchet mechanism 12, owing to the particular inclination of said tip 12*a*, which can slip over the teeth 10*a* of the gear 10 (FIG. 3).

To prevent the gear 10 from rotating in an anticlockwise direction, during anti-clockwise movement of the lever 11, there is provided a second pawl or ratchet mechanism 14 including a second tip or end 14*a*, said second ratchet mechanism being elastically biased by a spring 15 and partly contained within a groove 8*b* present in the case 8, the second tip 14*a* is also adapted for engagement with the teeth 10*a* of the gear 10, to hold the gear 10 in the position reached after clockwise oscillation of the lever 11, and thereby prevents it from returning by rotating in an anticlockwise direction during the anti-clockwise movement of the lever 11.

Also secured on said vertical axle 9 is a double stay 16 comprising a cable or web-like element which if made in a single piece as shown in FIG. 2 is routed through a vertical slot 17 formed on the same axle 9.

Thus, during the rotation of the axle 9, there occurs a winding of the two parts of the stay 16 with consequent shortening of their free length.

The free ends of said stay 16 are advantageously connected as shown best in FIG. 1 to the front half-quarter 3 by means of a riveted spot 18, for example.

As a result of such a configuration, during clockwise rotation of the vertical axle 9, the double stay is wound around the same, thereby causing the rear half-quarter 6 to be brought towards the front half-quarter 4, thereby closing the boot.

Clearly the stay may be embodied in any desired way, i.e. as a small cable or a plurality of small cables or a flexible strip.

To effect the opening of the boot it is necessary to release the gear 10 from the action of the first and second ratchet mechanisms, 12 and 14 respectively.

Figure 4:
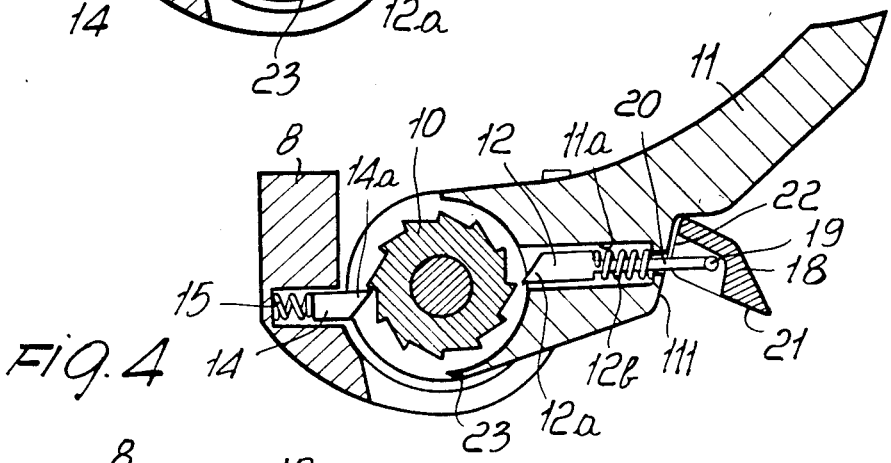
FIG. 4 is a sectional plan view of the ratchet level mechanism of FIG. 3, shown in a partially engaged condition thereof.
Figure 5:
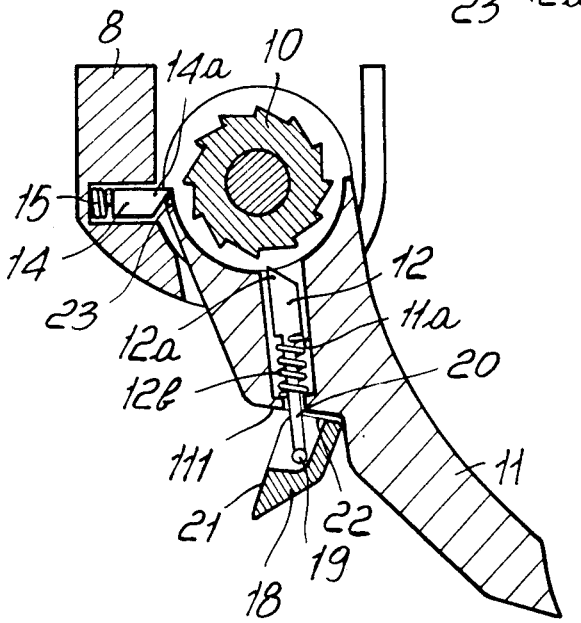
FIG. 5 is a further sectional plan view of the ratchet mechanism of FIG. 3, shown in disengaged condition thereof.

In order to release the first ratchet mechanism 12 there is provided a rotatable cam 18 (FIG. 4) associated by means of an off-centred pin 19 with the shank 20 of the ratchet mechanism 12 and having two faces, respectively 21 and 22, which, by virtue of the fact that the pin 19, is located closer to the face 21 than the face 22, on rotating the cam 19 to selectively position the ratchet mechanism 12, selectively permits the working length of the shank 20 to be selectively changed simply by pulling the cam against the biasing action of the spring 11*a* and then rotating it about the pin 19 to selectively engage one of said faces 21, 22 with a notch 111 provided on the lever 11 thereby causing engagement of the cited tip 12*a*, with or disengagement of the tip 12*a* from, the teeth 10*a* of the gear 10.

Thereafter, to release the second ratchet mechanism 14 the lever 11 is provided with an inclined front tooth 23 which, as the lever 11 is rotated into its full clockwise position, interferes with the ratchet mechanism 14 against the bias of the spring 15 thus moving the end 14*a* of the mechanism 14 away from the teeth 10*a* of the gear 10, which is thereby released and thus permits the axle 9 to rotate freely.

This operation is performed during the boot opening step.

The bottom portion of said vertical axle 9 has a thread formation 24 preferably a multi-start square screw thread, which is threadedly engaged during the rotation of the axle 9 by a correspondingly threaded sleeve 25, including a flange formation 26 adapted for rotatably securing it within a small guidable member or block 27.

The block 27 having a substantially parallelepipedal cross-section can slide within a vertical guide 27*a* formed inside the case 8.

During the rotation of the axle 9 there occurs the threading engagement of the same with the sleeve 25. Resultantly, clockwise rotation of the axle 9 generates an upwards closing movement of the block 27, thereby applying tension force to the cables 33, 34, and causing the hood 35 to press onto the foot instep region. Conversely, anti-clockwise rotation of the axle 9 generates a downward opening movement of the block 27, releasing the tension in the cables 33, 34 and thus releasing the hood 35 from the foot instep region.

Below said flange 26 the sleeve 25 defines on the exterior thereof, a gear 28, on which there acts a worm 29 rotatively housed in said block 27 and being actuatable from the outside of the case 8, by acting on an actuating knob or enlarged continuation 30, of its own axle, extending perpendicularly to said axle 9 and protruding through a vertical slot 8*b* provided in said case 8.

By acting, therefore, on the worm 29 according to the arrows 31 (FIG. 2), there occurs the positioning of the block 27 with respect to the thread formation 24 independently of the rotation of the vertical axle 9.

Once manually positioned the worm allows no rotation of the sleeve 25. As such, during the rotation of the vertical axle 9 the sleeve 25 remains stationary with respect to the block 27 while the same as already mentioned moves either upwards or downwards according to the arrows indicated at 32, on actuation of the ratchet lever 11.

Connected to the block 27 are two link elements advantageously comprising small cables 33 and 34 respectively.

The cables 33, 34 extend from the block 27 and pass out of the case 8, through small holes 8*c* provided at a bottom portion thereof. Each of the cited two cables then extends forwardly and downwardly along the rear half-quarter 6, and passes to the interior of the front half-quarter 3, substantially at the articulation points 5, which each include a guide element 5*a* comprising a pin or small wheel. The cables then extend, downwardly past their respective guide elements at the articulation points 5 and along the longitudinal direction of the boot 1, inbetween the interior surface of the shell 2 and the exterior of an inner boot (not shown), to a small capstan element 40 comprising a guide pin or small wheel, whereat, said cables are diverted upwardly to an instep presser element or hood 35, whereto they are attached.

With the cited structure, during upward movement of the block 27 which occurs simultaneously with the actuation of the ratchet lever 11 to provide closure of the rear half-quarter 6 on the front quarter 3 there also occurs a pulling force exerted upon the cables 33, 34 causing the hood 25 to be drawn downwardly such that it secures the foot instep region by pressing thereon within the shell 2.

Thus, the pulling force exerted by the cables 33 and 34 on the hood 35 can be adjusted independently of the force applied to the stay 16 by the lever 11 to close the boot merely by rotating the adjustment knob 30, to cause rotation of the worm 29, which in turn rotates the gear 28 and the thread formation 24, of the axle 9 causing the block 27 to move therealong and thus vary the working length of the cables 33, 34, thereby independently attenuating or enhancing the compressive force exerted on the foot instep by the hood 35.

It should be noted that the boot closing action and the foot instep pressing action are independently adjustable whilst being both simply obtained by actuating the same single lever both during the closing step and the opening step.

If after the full closure of the quarter-half 6 onto the front quarter 3 the compression of the hood 35 on the foot is not adequate, one can act directly on the control 30 and hence on the worm 29 to again achieve a translation of the block 27 by rotation of the threaded sleeve 25 engaged with the threaded section 24.

With the same action effected in the reverse direction one can also attenuate the effect of the hood 35 if the pressure exerted by the latter is excessive after closing the boot.

Once a proper calibration of the device has been carried out on the foot, at each successive fitting it will be sufficient to act on the ratchet lever only to simultaneously fully tighten the boot, and cause the hood to press on the foot instep region.

The passage of the cables 33 and 34 at the articulation point 5 of the two parts which make up the boot quarter, avoids any actions on the hood 35 due to rotation of the rear half-quarter 6 relatively to the front half-quarter 3.

This enables a perfect adjustment of the pull of the cables 33 and 34 due solely to the tightening device.

Alternatively to the hood 35 inside the shell, the closure on the foot instep may be achieved by pulling a hollow frusto-conical element which encircles the shell exterior.

Tensioning will be accomplished anyhow with at least one small cable or a stay associated with the block 27 of the device.

In an equivalent embodiment, the axle 9 may be made in two sections independent of each other but engaged, for example, by a front insert which may be disengaged by means of a preferably axial outer control.

Thus, the adjustment which was achieved with the worm may be eliminated or any other coarse adjustment device may be used such as a ring nut acting on the threaded sleeve.

From the foregoing description and illustration it may be noted that all of the inventions' objects are achieved and in particular, a lever means has been provided which is extremely simple and the actuation whereof enables one to close the boot and simultaneously effect the inner securing of the foot.

The two actions requiring to be different according to the wearer's foot conformation are made independent as regards adjustment but unitary in actuation.

This allows a considerable simplification of the devices, present on the boot for effecting opening and closure thereof, and securing the foot instep, which are reduced in practice to a single element.

Conveniently, as shown, the stays and cables may be in the forms of strips, webs, or proper cylindrical cross-section cables depending on convenience without departing from the scope of inventive concept.

Stays and cables may be conveniently contained within seats out of sight, formed in the boot structure.

Of course, the materials and dimensions may be any selected ones according to necessity.

Evidently, based on the same inventive concept, embodiments of the invention may be different and still be within the protection scope of the instant patent.

We claim:

1. A tightening and adjusting device particularly for ski boots including a shell having an instep portion, and a leg portion defining a quarter, including two sections articulated to each other, said device comprising entrainment means, actuating means, housing means, traction means, adjustment means and at least one stay member, said stay member defining a working length and having an entrainable portion and at least one end said at least one end being attached to one of said two sections, said entrainable portion being adapted to be entrained by said entrainment means, said entrainment means being adapted for co-operation with said actuating means for adjusting said working length defined by said stay member, said actuating means comprising an axle having rigidly associated therewith an inclined toothed gear wheel, said axle and said gear wheel being actuable by a ratchet lever, said device further comprising a presser element adapted for exerting pressure at said instep portion, at least one link element including a tractable portion, defining a working length dimension and having attached to said presser element, at least one end, said housing means being adapted for at least partially containing said entrainable portion of said stay member said actuating means and said entrainment means, said traction means including a thread formation, a sleeve having an outer flange, and a guided block, said thread formation being threaded into said sleeve, said sleeve being rotatably arranged in said guided block, said outer flange of said sleeve being contained in said guided block to prevent relative axial movement of said sleeve with respect to said guided block, said adjustment means including a gear, and a worm including a middle pin said gear being formed on said sleeve, said-middle pin protruding from said guided block for allowing manual actuation thereof, which by obtaining the rotation of said sleeve determines a mutual position of said guided block with respect to said axle, prior to rotation of the latter by actuation of said ratchet lever, said adjustment means being adapted for varying said working length dimension defined by said at least one link element independently of said actuating means.

2. A tightening and adjusting device according to claim 1 wherein said ratchet lever comprises a front wedge-like tooth, a first ratchet mechanism and a second ratchet mechanism, said first ratchet mechanism being releasable by means of a cam, said cam having two engagement faces, being journalled on said ratchet lever, and adapted for acting with one of said two engagement faces on an abutment formed on said actuating lever, one of said two engagement faces determining interference of said first ratchet mechanism with said toothed gear wheel, the other of said two engagement faces being adapted for freeing said first ratchet mechanism of any interference with said toothed gear wheel, said second ratchet mechanism being releasable from said toothed gear wheel by bringing said ratchet lever into a position of full opening, whereat said front wedge-like tooth interferes with said second ratchet mechanism by moving said second ratchet mechanism away from said toothed gear wheel.

3. A tightening and adjusting device according to claim 1 wherein said entrainment means comprises a slot formed in said axle, said at least one stay being formed of a simple strip having ends and being adapted, to be passed through said slot and wound around said axle during rotation thereof, said ends of said stay being rigidly attached to a front portion of said quarter.

4. A tightening and adjusting device according to claim 1 wherein said housing means comprises a case, said case including an axle centering and rotation seat and a guide seat, said guide seat being adapted for slidably accommodating said guided block and for co-operation with said actuating means for varying said working length dimension defined by said at least one link element.

* * * * *